United States Patent [19]

LaCroix

[11] Patent Number: 4,862,718

[45] Date of Patent: Sep. 5, 1989

[54] THREAD ROLLING DIES

[75] Inventor: Edward LaCroix, Temple City, Calif.

[73] Assignee: SPS Technologies, Inc., Newtown, Pa.

[21] Appl. No.: 219,625

[22] Filed: Jul. 14, 1988

[51] Int. Cl.[4] ..... B21H 3/06

[52] U.S. Cl. ..... 72/88; 72/469

[58] Field of Search ..... 72/469, 88, 90

[56] References Cited

U.S. PATENT DOCUMENTS

| | | | |
|---|---|---|---|
| 3,176,491 | 4/1965 | Mau et al. | 72/71 |
| 3,195,156 | 7/1965 | Phipard, Jr. | 10/10 |
| 3,260,100 | 7/1966 | Wieber | 72/469 |
| 3,538,739 | 11/1970 | Orlomoski | 72/469 |
| 3,654,791 | 4/1972 | Loos et al. | 72/469 |
| 3,910,099 | 10/1975 | Wilson | 72/469 |
| 4,136,416 | 1/1979 | Thomas | 10/10 |
| 4,546,639 | 10/1985 | Corrette | 72/469 |
| 4,576,033 | 3/1986 | Corrette | 72/469 |
| 4,631,947 | 12/1986 | Corrette | 72/88 |
| 4,713,954 | 12/1987 | Corrette | 72/88 |

FOREIGN PATENT DOCUMENTS

| | | | |
|---|---|---|---|
| 293620 | 12/1986 | Japan | 72/88 |
| 721208 | 3/1980 | U.S.S.R. | 72/469 |

OTHER PUBLICATIONS

Industrial Price List 3651—Hi-Life® Precision Tools, "Precision Flat Thread Rolling Dies", pp. 1-18, Dec. 1, 1975.

Advertising Brochure—SPS Technologies Hi-Life® Precision Tools, Jenkintown, Pa.

*Primary Examiner*—Daniel C. Crane

*Attorney, Agent, or Firm*—James D. Dee; Aaron Nerenberg

[57] ABSTRACT

Short thread rolling dies for forming a thread on a cylindrical body are disclosed comprising a face having a working configuration formed thereon for producing a thread on the cylindrical body with the face comprising a ramp surface inclined upwardly from a full form forward portion of the die to a height of from about one-third to about one-half thread depth and a dwell surface extending from the ramp surface to a finish portion of the die. The dwell surface has a length of from about two to about three times the circumference of the cylindrical body.

15 Claims, 3 Drawing Sheets

FIG. 1
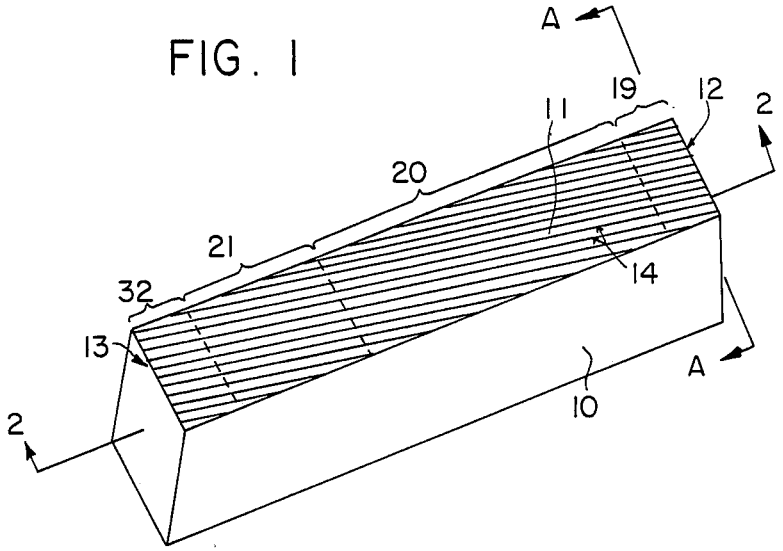
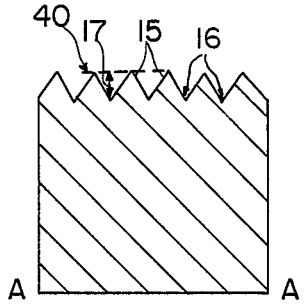
FIG. 3

THREAD ROLLING DIES

BACKGROUND OF THE INVENTION

The present invention relates generally to the field of thread rolling dies and in particular to a boltmaker style flat die for forming threads on a cylindrical fastener blank.

Thread rolling dies are a known means for rolling a thread form on bolts, studs, etc., and are generally rectangular plate members having one surface thereon serrated. These serrations include alternate ridges and grooves, which conform in plan to the shape of the screw threads to be rolled. The serrations run the length of the die face and are inclined with respect to the longitudinal axis of the die face at an angle corresponding to the lead angle of the threads to be rolled. The dies are used in mating pairs with their serrated faces facing each other. A cylindrical blank of the bolt to be threaded is placed between the dies at one end thereof. The dies are then pressed against the shank portion of the blank and one of the dies is moved longitudinally, thereby rotating the blank about its axis and roll forming the screw threads thereon.

Boltmaker style thread rolling dies known in the art usually have a start, which is a chamfer with depth equivalent to thread depth, and a ramp region on the die to permit the die to penetrate the cylindrical blank at a controlled rate until full depth is reached. These dies also have a dwell portion, which is normally one-half the length of the die, to provide an "ironing out" action or smoothing operation that develops the full depth of the threads. Additionally, these dies usually have a roll-off section which permits the gradual loss of contact between the die and screw, without marking the finished workpiece. Dies of this type have been used in the past to roll single thread forms on cylindrical blanks and have been found to be a relatively fast and efficient method of forming threaded members. However, large rolling forces to which the dies are subjected during the thread forming process, thereby resulting in reduced die life.

Accordingly, it is a general object of the present invention to provide thread rolling dies which overcome the disadvantages of the prior art. It is a further object of the present invention to provide thread rolling dies which have a longer tool life with minimal cost increase. A still further object of the present invention is to provide thread rolling dies that are simple and durable in construction, economical to manufacture, and highly efficient in operation.

SUMMARY OF THE INVENTION

These and other objects of the instant invention are achieved by providing a thread rolling short or stationary die for forming a thread on a cylindrical body comprising a face having a working configuration formed thereon for producing a thread on the cylindrical body with the face comprising a ramp surface inclined upwardly from a full form radius or straight starting relief forward portion of the short or stationary die to a height of from about one-third to about one-half thread depth and a dwell surface extending from the ramp surface to a finish relief portion of the die, wherein the dwell surface has a length of from about two to about three times the circumference of the cylindrical body. More particularly, the die is a flat die type wherein the ramp surface and the dwell surface are planar surfaces with thread forming grooves therein. Preferably, the ramp surface is inclined upwardly from the full form radius starting relief forward portion of the die to a height of about one-third thread depth and the dwell surface has a length of about twice the circumference of the cylindrical body. The full form radius starting relief forward portion of the die comprises a full form radius forward surface inclined upwardly from the front edge of the face to a height of from about one-fourth to about one-half thread depth with the forward surface extending from the front edge to the ramp surface. Moreover, the forward surface has a length about equal to the diameter of the cylindrical body and, preferably, is inclined upwardly from the front edge of the face to a height of about one-fourth thread depth. The finish relief portion of the short or stationary die comprises a finish surface inclined downwardly from the dwell surface to a depth of from about three-fourths to about one thread depth with the finish surface extending from the dwell surface to a finish edge of the face. The finish surface has a length of about one to about one and one-half the diameter of the cylindrical body.

In accordance with another embodiment of the present invention, a pair of complementary dies is provided with the short or stationary die of the pair comprising a face having a working configuration formed thereon as described above and the long or moving die of the pair comprising a face having a working configuration formed thereon with the face generally comprising a ramp surface inclined upwardly from the front edge of the face to a height of from about one-half to about one thread depth and a dwell surface extending from the ramp surface to the finish edge of the face, wherein the lengths of the ramp and dwell surfaces of the long die are proportionally longer than the ramp and dwell surfaces of the short die. Only the short die of the pair has a full form radius or straight starting relief and a finish relief.

Thread roll dies in accordance with this invention provide dies having greatly increased tool life.

BRIEF DISCUSSION OF THE DRAWINGS

FIG. 1 is a perspective view of a die in accordance with the present invention;

FIG. 3 is an exaggerated cross section taken along A—A of FIG. 1 illustrating the full form thread form at the front edge of a short or stationary die in accordance with the present invention;

DETAILED DESCRIPTION OF THE INVENTION

Figure 2:
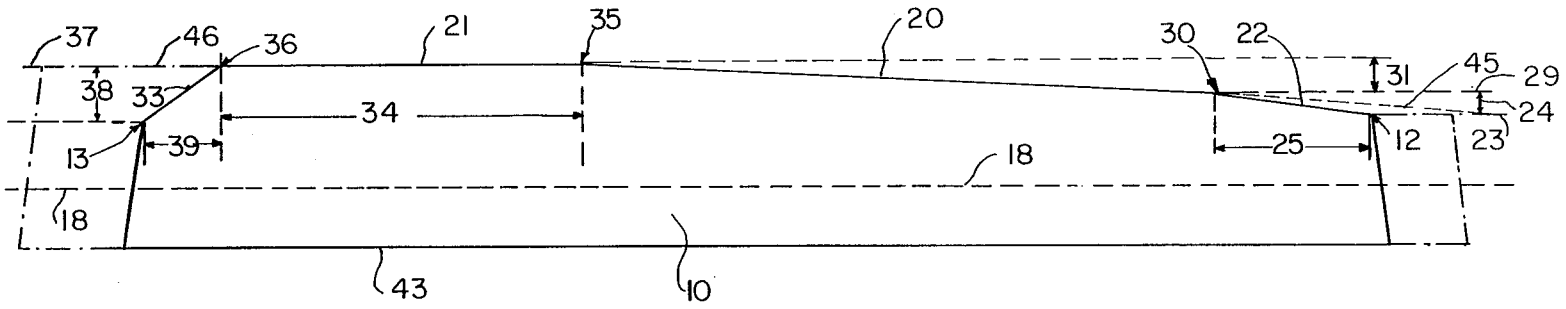
FIG. 2 is an exaggerated schematic longitudinal view along 2—2 of FIG. 1 illustrating the configuration of a die in accordance with the present invention.

Referring to FIGS. 1 through 4, a thread rolling short or stationary die 10 for forming a thread on a cylindrical body is illustrated in accordance with a preferred embodiment of this invention. The die 10 has a flat thread rolling die configuration for forming a thread on a cylindrical male fastener blank and is comprised of a substantially rectangular die member. One face 11 of the die 10 extends longitudinally from a front edge 12 to a finish edge 13. The face 11 has serrations 14 thereon for forming the thread on the cylindrical body. The serrations 14 extend across the face 11 to form parallel alternate ridges 15 and grooves 16 (as illustrated in FIG. 3). As will be appreciated by those skilled in the art, the ridges 15 and grooves 16 of the serrations 14 can be any appropriate size or shape.

As will be more fully described hereinafter, the ridges 15 and grooves 16 of the serrations 14 are complementary to and form the thread on the cylindrical body. Accordingly, the thread will have a crest and a root complementary to the ridge 15 and groove 16, respectively, and the thread depth will approximate the serration depth 17. The thread depth, as the term is used herein, is defined as the depth from the crest to the root or, more particularly, the distance from a plane defined by two adjacent crests of the thread to the root as measured perpendicularly from the plane.

The serrations 14 are inclined with respect to the longitudinal axis 18 of the die 10 at an angle which corresponds to the lead angle of the threads to be rolled. The spacing between each successive ridge and each successive groove is equal to the pitch of the threads to be rolled. In the preferred embodiment of the present invention, the shape and size of the ridges 15 and grooves 16 of the serrations 14 on the face 11 are equal.

Figure 4:
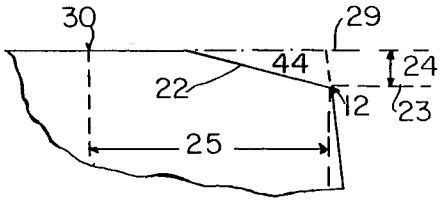
FIG. 4 is an exaggerated schematic fragmentary view illustrating the full form radius and straight starting relief front portion of a short or stationary die in accordance with the present invention.

As illustrated in FIG. 1, the face 11 of the short or stationary die generally comprises a full form radius forward portion 19 extending from the front edge 12, a ramp surface 20 inclined upwardly from the full form radius forward portion 19, a dwell surface 21 extending from the ramp surface 20, and a finish portion 32 extending from the dwell surface 21 to the finish edge 13. Referring now to FIG. 2, which shows an exaggerated profile in order to better illustrate the various dimensions of this invention, the full form radius forward portion 19 is preferably a full form radius forward surface 22 inclined upwardly from the front edge 12 radially from a first plane 23. The first plane 23 is generally defined by the front edge 12 and is parallel to the longitudinal axis 18 or back 43 of the die 10. The full form radius forward surface 22 is inclined upwardly from the front edge 12 to a perpendicular height 24 relative to the first plane 23 of from about one-fourth to about one-half thread depth. Preferably, the height 24 is about one-fourth thread depth +/−0.001 inches. The forward surface 22 also has a length 25 relative to the first plane 23 equal to about the diameter 27 of the cylindrical blank +/−0.062 inches. The forward portion can alternatively be a full form straight forward portion 44 as illustrated in FIG. 4. The term "full form" as used herein means that the serrations or thread form is not truncated at the front edge of the die as illustrated in FIG. 3.

The ramp surface 20 is inclined upwardly from the forward surface 22 at an acute angle from a second plane 29 to the dwell surface 21. This acute angle is determined by the applicable thread depth. The second plane 29 is generally defined by the intersection 30 of the forward surface 22 with the ramp surface 20 and is parallel to the longitudinal axis 18 or back 43 of the die 10. The ramp surface 20 is inclined upwardly from the second plane 29 to a perpendicular height 31 relative to the second plane 29 of from about one-third to about one-half thread depth. Preferably, the height 31 is about one-third thread depth +/−0.001 inches. The length of the ramp surface 20 is generally greater than the length of the dwell surface 21 relative to the longitudinal axis 18.

The dwell surface 21 is generally parallel to the longitudinal axis 18 or back 43 of the die 10 and extends from the ramp surface 20 to a finish surface 33. The dwell surface 21 can have a length 34 of from about two to about three cylindrical body part revolutions or circumferences. Preferably, the length 34 is about two part revolutions or about twice the circumference of the cylindrical blank +/−0.062 inches. The length 34 is measured from the intersection 35 of the ramp surface 20 with the dwell surface 21 to the intersection 36 of the dwell surface 21 with the finish surface 33.

The finish portion 32 is comprised of a finish surface 33 inclined downwardly from the dwell surface 21 at a radius or an acute angle from a third plane 37 to the finish edge 13. The acute angle or radius is determined by the applicable thread depth. The third plane 37 is generally defined by the intersection 36 of the dwell surface 21 with the finish surface 33 and is parallel to the longitudinal axis 18 of the die 10. The finish surface 33 is inclined downwardly from the dwell surface 21 to a perpendicular depth 38 relative to the third plane 37 of from about three-fourths to about one thread depth. Preferably, the finish surface 33 has a depth 38 of about three-fourths thread depth. The finish surface 33 also has a length 39 relative to the third plane 37 of from about one to about 1 ½ the diameter 27 of the cylindrical blank 28. Preferably, the length 39 of the finish surface 33 is about equal to the diameter 27 of the cylindrical blank 28.

FIG. 3 shows an exaggerated cross section taken along A—A of FIG. 1 illustrating the full form radius forward portion 19 of the die 10 and the ridges 15 and grooves 16 of the serrations 14. As described hereinbefore, the ridges 15 and grooves 16 are complementary to and form the threads on the cylindrical body 28. The serration depth 17, which is the depth from a plane 40 defined by two adjacent ridges 15 to a groove 16 as measured perpendicularly from the plane 40, corresponds to the thread depth to be formed.

In practice, a pair of complementary dies in accordance with the present invention is utilized. A short or stationary die of the pair provides a face having a working configuration formed thereon for producing threads on the cylindrical body as described in detail above. The dies are comprised of hardened steel or other material known in the art and are preferably heat treated for maximum hardness. The long die has a face comprising a ramp surface inclined upwardly from the front edge of the face to a height of from about one-half to about one thread depth and a dwell surface extending from the ramp surface to the finish edge of the face. As illustrated in FIG. 2, the long die's ramp surface 45 and the long die's dwell surface 46 are longer than the ramp and dwell surfaces of the short die. The long die also does not have either a full form starting relief or a finish relief.

Figure 5:
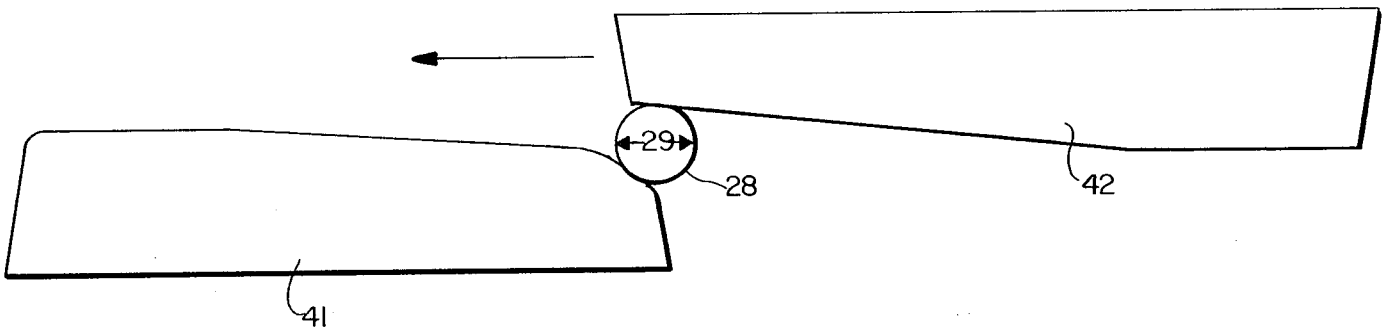
FIG. 5 is a schematic representation showing a pair of thread roll dies in accordance with the present invention rolling a thread formation on a cylindrical body.

As illustrated in FIG. 5, to form or roll a thread on the cylindrical blank 28, a pair of complementary dies in accordance with the present invention are placed substantially parallel to each other in overlapped relationship so that one die, known as the short or stationary die 41, is leading and the other, known as the long or moving die 42, is trailing. The blank pick-up forward portion of the short die can have a length equal to about one-half the difference between the length of the long and short dies. For example, if the short die is 4 ¼" long and the long die is 5" long, the forward portion will be about ⅜" long. The cylindrical blank 28 is placed between the dies which are then pressed toward each other to compressively contact the cylindrical blank 28. The short or stationary die 41 is held immobile and the long or moving die 42 is moved longitudinally, thereby rolling the cylindrical blank about its longitudinal axis. The movement of the dies in conjunction with the compressive force placed thereon, causes the material of the cylindrical blank to flow into the groove portions of the dies and out of the ridge portions thereof to thus form the thread configuration on the blank. Those skilled in the art can appreciate the large rolling forces to which the dies are subjected during the thread forming process, thereby resulting in reduced die life. The thread rolling dies in accordance with the present invention have greatly improved die life over conventional dies known in the art.

Studies were conducted to evaluate and compare the thread rolling dies of the instant invention with standard dies known in the art. One-quarter inch screw size parts were thread rolled with dies of both types and die life was then monitored. The experimental dies of the present invention were run on age hardened cold rolled INCO 718 without heat because of the lead in these dies. The experimental dies were also heat treated for increased hardness. The standard dies had a dwell surface with a length of about one-half the die length and a chamfer start with a depth equivalent to about the thread depth. The standard dies were run on age hardened cold rolled INCO 718 with 500°-600° heat. A total of 9,368 pieces were produced using the dies in accordance with this invention versus 5,100 pieces using the standard dies. These results indicate that the dies of this invention have greatly improved die life over the standard dies.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A thread rolling die for forming a thread on a cylindrical body comprising a face having a generally longitudinally extending working configuration formed thereon for producing a thread on the cylindrical body, the face comprising a ramp surface inclined upwardly from a full form forward portion of the die to a perpendicular height relative to a plane generally defined by the intersection of the forward portion with the ramp surface of from about one-third to about one-half thread depth, said full form comprising serrations or thread form which is not truncated at the front edge of the die, said thread depth being the depth from the crest to the root of the thread, and a dwell surface extending from the ramp surface to a finish relief portion of the die, the dwell surface having a length of form about two to about three times the circumference of the cylindrical body.

2. The thread rolling die in accordance with claim 1 wherein the die is a short flat die, the ramp surface and the dwell surface are planar surfaces with thread forming grooves therein.

3. The thread rolling die in accordance with claim 2 wherein the full form forward portion of the die comprises a full form radius forward surface inclined upwardly from the front edge of the face to a height of from about one-fourth to about one-half thread depth, the forward surface extending from the front edge to the ramp surface.

4. The thread rolling die in accordance with claim 3 wherein the forward surface has a length of about equal to the diameter of the cylindrical body and is inclined upwardly from the front edge of the face to a height of about one-fourth thread depth.

5. The thread rolling die in accordance with claim 2 wherein the finish portion of the die comprises a finish surface inclined downwardly from the dwell surface to a depth of from about ¾ to about one thread depth, the finish surface extending from the dwell surface to a finish edge of the face.

6. The thread rolling die in accordance with claim 5 wherein the finish surface has a length of about one to about 1 ½ the diameter of the cylindrical body.

7. The thread rolling die in accordance with claims 2, 3, 4, or 6, wherein the ramp surface is inclined upwardly from the full form radius forward portion of the die to a height of about ⅓ thread depth and the dwell surface has a length of about twice the circumference of the cylindrical body.

8. A fault thread rolling die configuration for forming a thread on a cylindrical fastener blank comprising a substantially rectangular short die member, one face of the rectangular short die member extending longitudinally from a front edge to a finish edge and having serrations thereon for forming the thread, said serrations being generally inclined with respect to a longitudinal axis of the die member, the thread having a crest and a root wherein the depth from crest to the root defines the thread depth, the face comprising:

a full form radius forward surface inclined upwardly from the front edge at an acute angle from a first plane, which is generally defined by the front edge and which is parallel to the longitudinal axis of the die member, to a height relative to the first plane of about ¼ thread depth, the forward surface having length relative to the first plane equal to about the diameter of the cylindrical blank and the full form comprising serrations or thread form which is not truncated at the front edge of the die member;

a ramp surface inclined upwardly from the forward surface at an acute angle from a second plane, which is generally defined by the intersection of the forward surface with the ramp surface and which is parallel to the longitudinal axis of the die member, to a height relative to the second plane of about ⅓ thread depth;

a dwell surface generally parallel to the longitudinal axis of the die member and extending from the ramp surface, the dwell surface having a length of about twice the circumference of the cylindrical blank; and a finish surface inclined downwardly from the dwell surface at an acute angle from a third plane, which is generally defined by the intersection of the dwell surface with the finish surface and which is parallel to the longitudinal axis of the die member, to a depth relative to the third plane of from about ¾ to about one thread depth, the finish surface extending from the dwell surface to a finish edge of the face.

9. Thread rolling dies for forming threads on a cylindrical body comprising a pair of dies, including a short die and a long die, each die providing a configuration formed thereon for producing a thread on the cylindrical body, the short die having a face comprising a ramp surface inclined upwardly from a full form starting relief forward portion of the die to a perpendicular height relative to a plane generally defined by the intersection of the forward portion with the ramp surface of from about one-third to about one-half thread depth, said full form comprising serrations or thread form which is not truncated at the front edge of the short die, said thread depth being the depth from the crest to the root of the thread, and a dwell surface extending from the ramp surface to a finish relief portion of the die, the dwell surface having a length of from about two to about three times the circumference of the cylindrical body, the long die having a face comprising a ramp surface inclined upwardly from the front of the face to a height of from about one-half to about one thread depth and a dwell surface extending from the ramp surface to the finish edge of the face, wherein the lengths of the ramp and dwell surfaces of the long die are longer than the ramp and dwell surfaces of the short die.

10. Thread rolling dies in accordance with claim 9 wherein each die is a flat die, the ramp surface and the dwell surface of each die are planar surfaces with thread forming grooves therein, the ramp surfaces and the dwell surfaces being spaced and substantially parallel to each other when the pair of dies operate, thereby forming threads on the cylindrical body.

11. Thread rolling dies in accordance with claim 9 wherein the full form starting relief forward portion of the short die comprises a full form radius forward surface inclined upwardly from the front edge of the face to a height of from about one-fourth to about one-half thread depth, the forward surface extending from the front edge to the ramp surface.

12. Thread rolling dies in accordance with claim 11 wherein the full form radius forward surface has a length about equal to the diameter of the cylindrical body and is inclined upwardly from the front edge of the face to a height of about one-fourth thread depth.

13. Thread rolling dies in accordance with claim 9 wherein the finish relief portion of the short die comprises a finish surface inclined downwardly from the dwell surface to a depth of from about $\frac{3}{4}$ to about one thread depth, the finish surface extending from the dwell surface to a finish edge of the face.

14. Thread rolling dies in accordance with claim 13 wherein the finish surface of the short die has a length of about one to about $1\frac{1}{2}$ the diameter of the cylindrical body.

15. Thread rolling dies in accordance with claims 10, 12, or 14, wherein the ramp surface of the short die is inclined upwardly from the full form radius forward portion of the die to a height of about $\frac{1}{3}$ thread depth and the dwell surface has a length of about twice the circumference of the cylindrical body.

* * * * *